US010479454B2

(12) United States Patent
Barwick

(10) Patent No.: US 10,479,454 B2
(45) Date of Patent: Nov. 19, 2019

(54) FOLDABLE WATERCRAFT CHAIR

(71) Applicant: Ronald H. Barwick, Oxford, FL (US)

(72) Inventor: Ronald H. Barwick, Oxford, FL (US)

( * ) Notice: Subject to any disclaimer, the term of this patent is extended or adjusted under 35 U.S.C. 154(b) by 0 days.

(21) Appl. No.: 15/951,383

(22) Filed: Apr. 12, 2018

(65) Prior Publication Data

US 2019/0054983 A1 Feb. 21, 2019

Related U.S. Application Data

(60) Provisional application No. 62/546,319, filed on Aug. 16, 2017.

(51) Int. Cl.

| | |
|---|---|
| ***B63B 29/04*** | (2006.01) |
| ***A47C 1/14*** | (2006.01) |
| ***A47C 4/28*** | (2006.01) |
| *B63B 29/02* | (2006.01) |

(52) U.S. Cl.

CPC ..... *B63B 29/04* (2013.01); *A47C 1/146* (2013.01); *A47C 4/28* (2013.01); *B63B 2029/022* (2013.01); *B63B 2029/043* (2013.01)

(58) Field of Classification Search

CPC ..... A47D 1/10; A47C 1/143; B63B 29/06; B63B 2029/043

See application file for complete search history.

(56) References Cited

U.S. PATENT DOCUMENTS

| | | | | |
|---|---|---|---|---|
| 2,446,036 | A * | 7/1948 | Vit Zdanaitis | A47C 5/046 297/130 |
| 6,435,126 | B1 | 8/2002 | Burke | |
| 7,832,804 | B2 * | 11/2010 | LaFreniere | A47C 1/03 297/31 |
| 7,900,575 | B2 | 3/2011 | Walbridge et al. | |
| 8,028,641 | B1 | 10/2011 | Sly | |
| 8,479,664 | B2 | 7/2013 | Nelson | |
| 9,199,696 | B1 * | 12/2015 | Bonell | B63B 21/20 |

* cited by examiner

*Primary Examiner* — Andrew Polay
(74) *Attorney, Agent, or Firm* — Global Intellectual Property Agency, LLC; Daniel Boudwin

(57) ABSTRACT

A watercraft chair. The watercraft chair is made of a frame assembly with a seat frame, a backrest frame and a footrest frame. A covering is disposed over the frame assembly. A plurality of fasteners extends from the backrest frame to attach the watercraft chair to a watercraft. The watercraft chair is movable between a folded and usable position.

8 Claims, 5 Drawing Sheets

FOLDABLE WATERCRAFT CHAIR

CROSS REFERENCE TO RELATED APPLICATIONS

This application claims the benefit of U.S. Provisional Application No. 62/546,319 filed on Aug. 16, 2017. The above identified patent application is herein incorporated by reference in its entirety to provide continuity of disclosure.

BACKGROUND OF THE INVENTION

The present invention relates to a foldable watercraft chair. Many people enjoy going on watercraft with their family and friends. While in open water, however, some swimmers may wish to sit down on a stable surface. Usually, people have to climb out of the water completely in order to sit on a stable surface. Constantly getting in and out of the water can be a frustrating and inconvenient process. Furthermore, swimmers may find a partially submerged seat to be preferable to a seat that requires them to be entirely above the water in order to use it. Flotation devices that do enable users to remain partially submerged in the water can daft away from watercraft, requiring the user to swim back to the watercraft while holding the flotation device.

Current watercraft chairs disclose hinged seats that affix to a watercraft that can convert from an onboard seat to an outboard seat for use in water. Furthermore, watercraft chairs are available that are pivotable between a usable position and a storable position. However, these currently available devices do not provide a seat that is adapted to be partially submerged under water.

SUMMARY OF THE INVENTION

In view of the foregoing disadvantages inherent in the known types of watercraft chairs now present in the prior art the present invention provides a watercraft chair wherein the same can be utilized for providing convenience for the user when installed to enable the user to be partially submerged in water.

The present system comprises a f assembly including a seat frame, a backrest frame and a footrest frame. The footrest frame is movably connected to the seat frame and the backrest frame is movably connected to the seat frame opposite of the footrest frame. A covering is placed over the frame assembly and is adapted to receive the user thereon. A plurality of fasteners is attached to the backrest frame and configured to secure the watercraft chair to a side of a watercraft Another object of the present invention is to provide a foldable watercraft chair that has arm rests to further enhance the comfort and usability for the user.

A further object of the present invention is to provide a mechanism for a user to adjust the distance between the watercraft chair and the watercraft from which the watercraft chair is attached.

Yet another object of the present invention is to provide a watercraft chair with a covering that made from a waterproof material to prevent mold and mildew from forming on the watercraft chair.

Still yet another object of the present invention is provide a watercraft chair that is easily and conveniently stowed away. Under this object, the watercraft chair has a folded position adapted to enable the user to store the watercraft chair while the watercraft is in use. Furthermore, the watercraft chair has a useable position configured to receive the user thereon.

A further object of the present invention is to provide a watercraft chair that is securable to the side of a watercraft by a plurality of suction cups wherein the suction cups form a seal incapable of being weakened by the presence of water.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
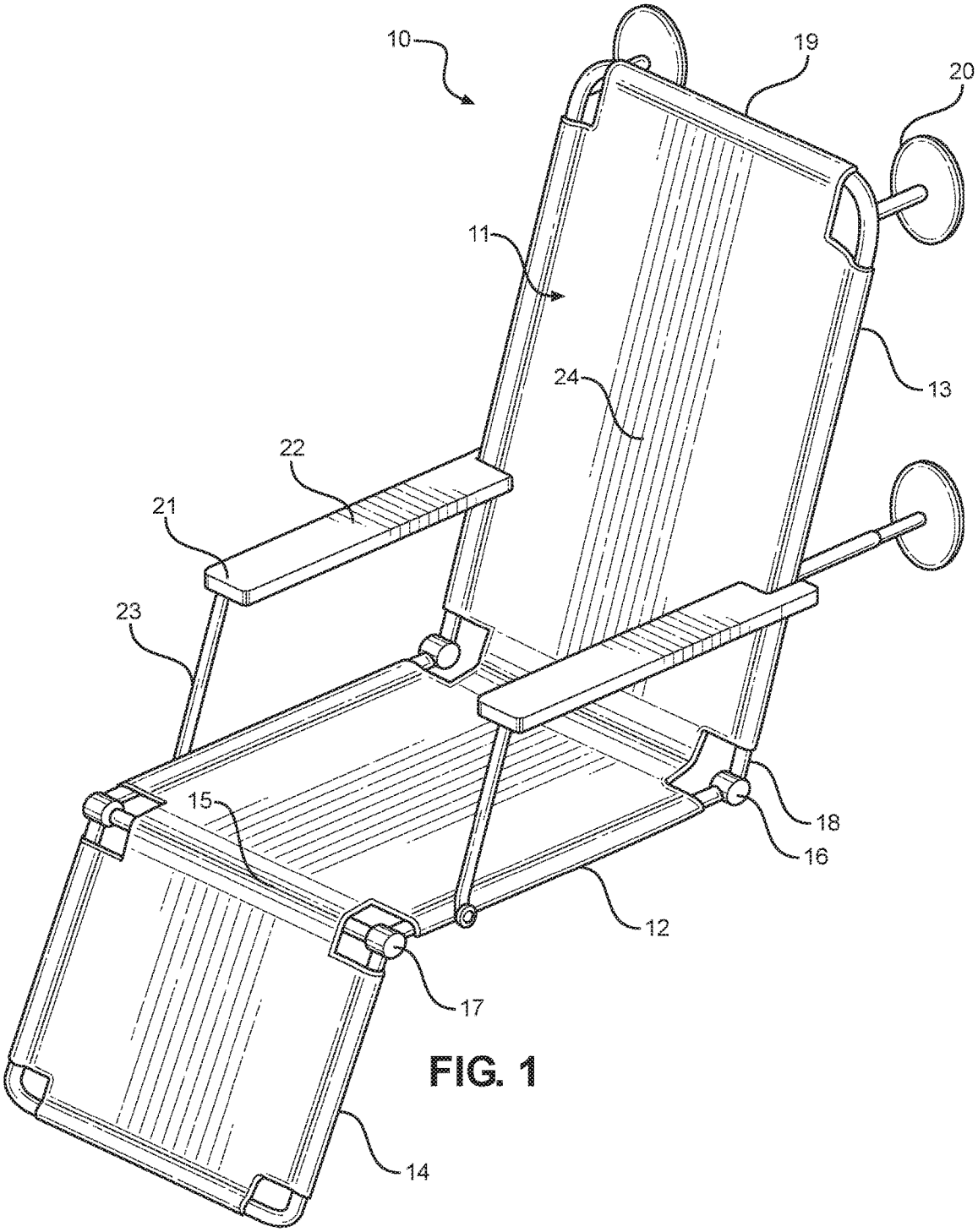
FIG. 1 shows a perspective view of the watercraft chair placed in the usable position.

Reference is made herein to the attached drawings. Like reference numerals are used throughout the drawings to depict like or similar elements of the watercraft chair. The figures are intended for representative purposes only and should not be considered to be limiting in any respect.

Referring now to FIG. 1, there is shown perspective view of the watercraft chair placed in the usable position. The watercraft chair 10 is comprised of a frame assembly 11 wherein the frame assembly 11 is composed of a seat frame 12 with a backrest frame 13 attached thereon opposite of a footrest frame 14. A support bar 15 is suspended across a connection point of the seat frame 12 and the footrest frame 14.

The seat frame 12 is formed by a covering disposed between two seat frame rods and is configured to receive a backside of a user thereon. Furthermore, the seat frame 12 has four corners defined by each end of the two seat frame rods, wherein two corners form a plurality of backrest connection points 16 and the two opposite corners form the footrest connection points 17. The corners of the backrest connect points 16 are connected to the backrest frame 13 by a first plurality of partially movable joints 18. The partially movable joints 18 are configured to lock at a specific angle wherein the seat frame 12 is placed in a configuration relative to the backrest frame 13 to enable a user to comfortably sit on the seat frame 12 and rest a back of the user on the backrest frame 13.

The backrest frame 13 is comprised of a first u-shaped rod 19 forming an opening wherein a covering is disposed over the opening to receive the back of a user. The backrest frame 13 comprises a front face and a back face. A plurality of fasteners 20 is disposed on an outer perimeter of the back face. The plurality of fasteners 20 is configured to correspond to a watercraft and to secure the watercraft chair 10 to a side of a boat. Furthermore, the plurality of fasteners 20 is configured to function while above water and while submerged in water. In the illustrated embodiment, the plurality of fasteners 20 is a plurality of suction cups wherein the suction cups are configured to secure the watercraft chair 10 to the side of the boat. In another embodiment, a plurality of hooks extend from an upper edge of the backrest frame 13 and are configured to provide additional support by resting over a ledge of a watercraft.

In a further embodiment, the plurality of suction cups are controllable by an actuation of a lever. Under this embodiment, each suction cup of the plurality of suction cups is operably connected to a lever wherein the lever is configured to break a vacuum seal produced through a suction of the suction cup upon actuation of the lever.

The footrest frame 14 is comprised of a second u-shaped rod 21 forming an opening wherein a covering is disposed over the opening to receive the legs of the user. The footrest frame 14 is rotatable around the support bar 15 to enable the user to adjust the position of the footrest frame 14. The footrest frame 14 is connected by a plurality of footrest connection points 17. In one embodiment, the footrest connection points 17 comprise a locking mechanism wherein the footrest frame 14 may be locked into a desired position by the user.

In one embodiment the watercraft chair further comprises a plurality of arm rests 21. Each arm rest of the plurality of arm rests 21 is comprised of a primary bar 22 configured to receive an arm of the user and a secondary bar 23 configured to provide support to the primary bar 22. The primary bar 22 is attached at an end to the backrest frame 14. The secondary bar 23 is attached to the primary bar 22 opposite of an attachment point to the backrest frame 14 thereof.

In a further embodiment of the watercraft chair, the coverings of the seat frame, the backrest frame and the footrest frame form a single covering 24. The covering 24 is made of a flexible material configured to provide support to the user. In one embodiment, the covering 24 is made of a waterproof material to prevent the growth of mold or mildew thereon.

Figure 2:
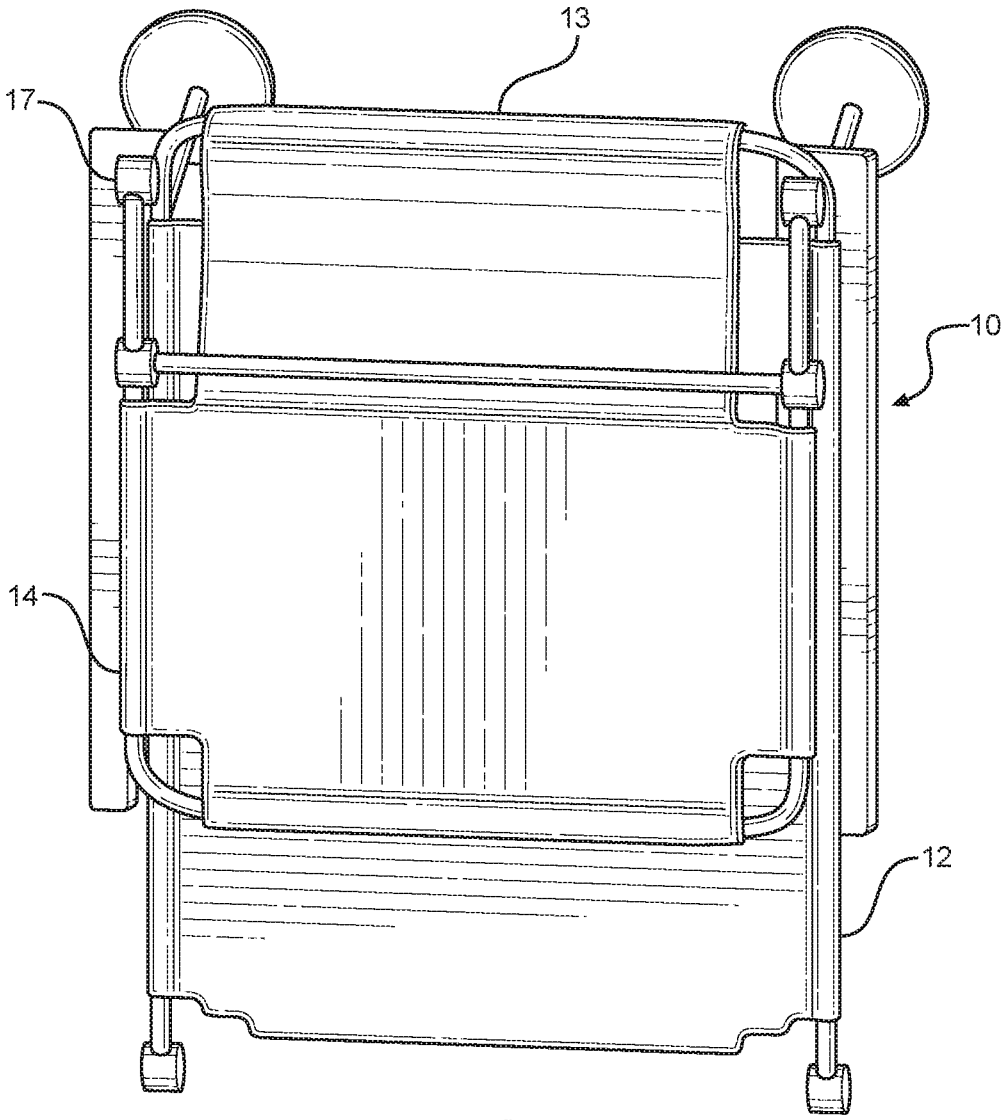
FIG. 2 shows a perspective view of the watercraft chair placed in the folded position.

Referring now to FIG. 2 there is shown a perspective view of the watercraft chair placed in the folded position. The watercraft chair 10 is configured to be movable by a user between a usable position and a folded position. The folded position is defined wherein the seat frame 12 is folded along the backrest connection point to a parallel position with the backrest frame 13 and the footrest frame 14 is folded along the footrest connection point 17 to a parallel position with the seat frame 12.

Figure 3:
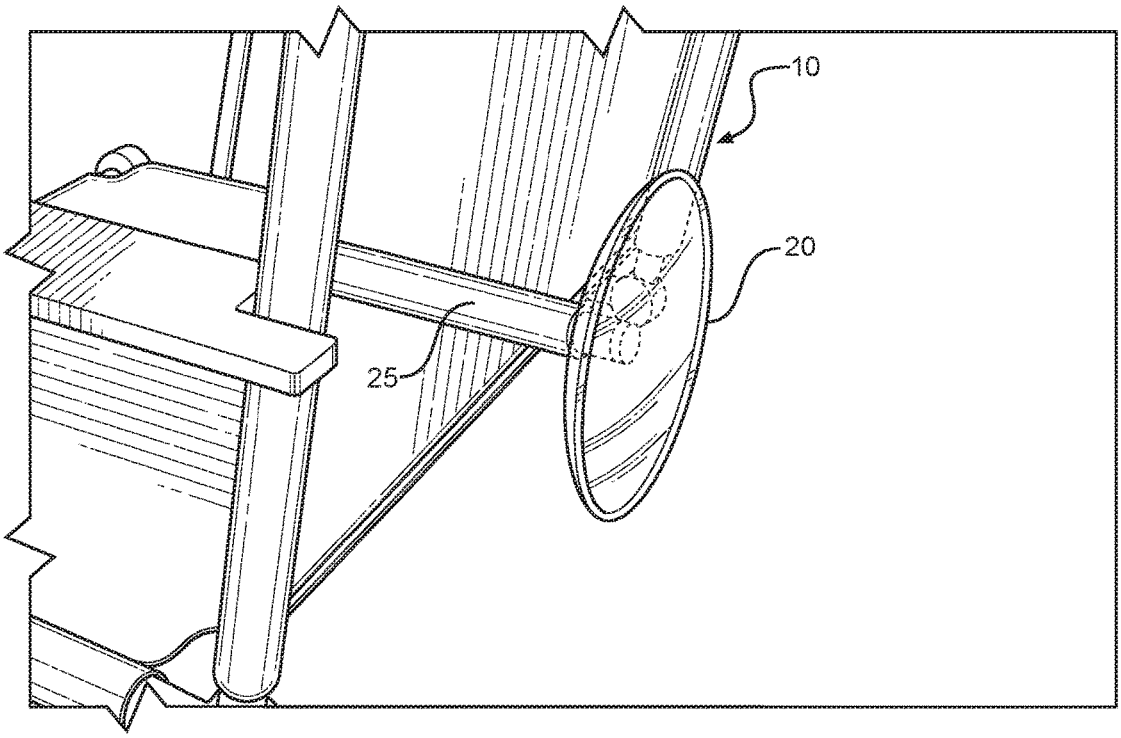
FIG. 3 shows a close up view of a fastener of the watercraft chair wherein the fastener is in the default position.
Figure 4:
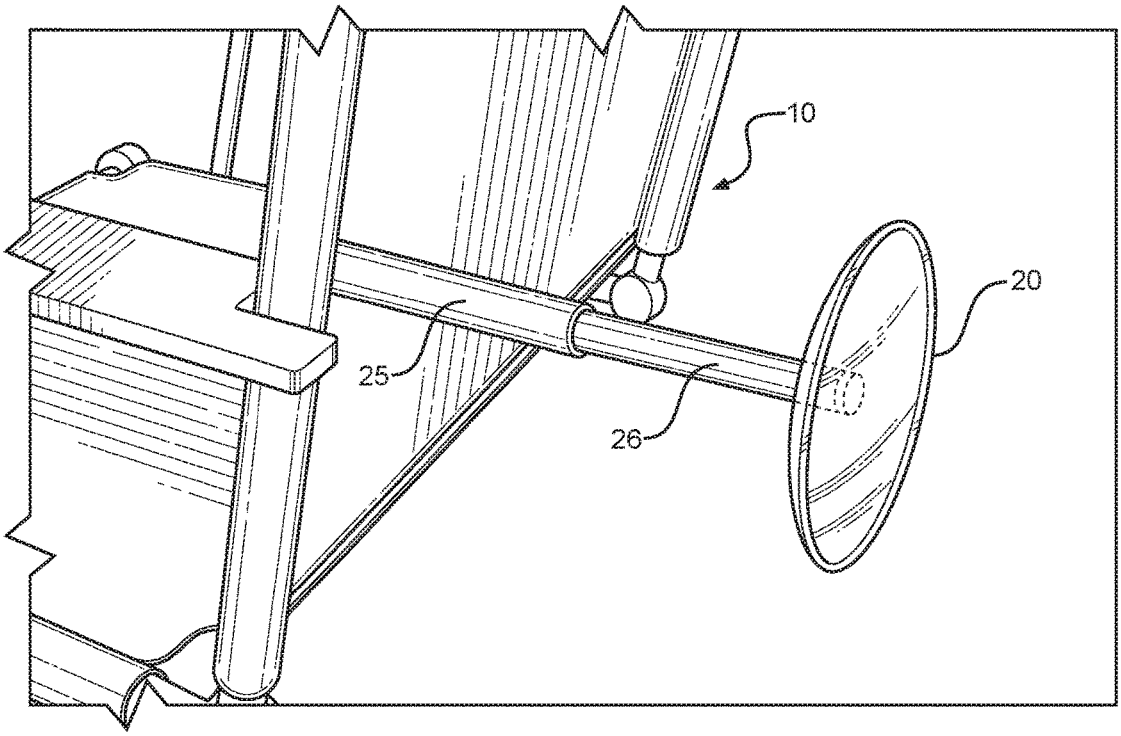
FIG. 4 shows a close up view of a fastener of the watercraft chair wherein the fastener is in the extended position.

Referring now to FIGS. 3 and 4, there are shown close up views of a fastener of the watercraft chair wherein the fastener is in a non-extended position and an extended position respectively. In one embodiment, the watercraft chair 10 further comprises a plurality of adjustable arms 25 configured to connect the plurality of fasteners 20 to the back face of the backrest frame 13. Each adjustable arm of the plurality of adjustable arms 25 is comprised of a first arm 26 slidably receivable into a second arm 27 wherein sufficient frictional resistance enables stability of the watercraft chair 10. The presence of the plurality of adjustable arms 25 will enable the user to adjust the distance between the backrest frame 13 of the watercraft chair 10 and the watercraft. In another embodiment each adjustable arm of the plurality of adjustable arms 25 are connected to a hinge configured to allow the user to adjust the angle of the watercraft chair 10 in relation to the surface of the water.

Figure 5:
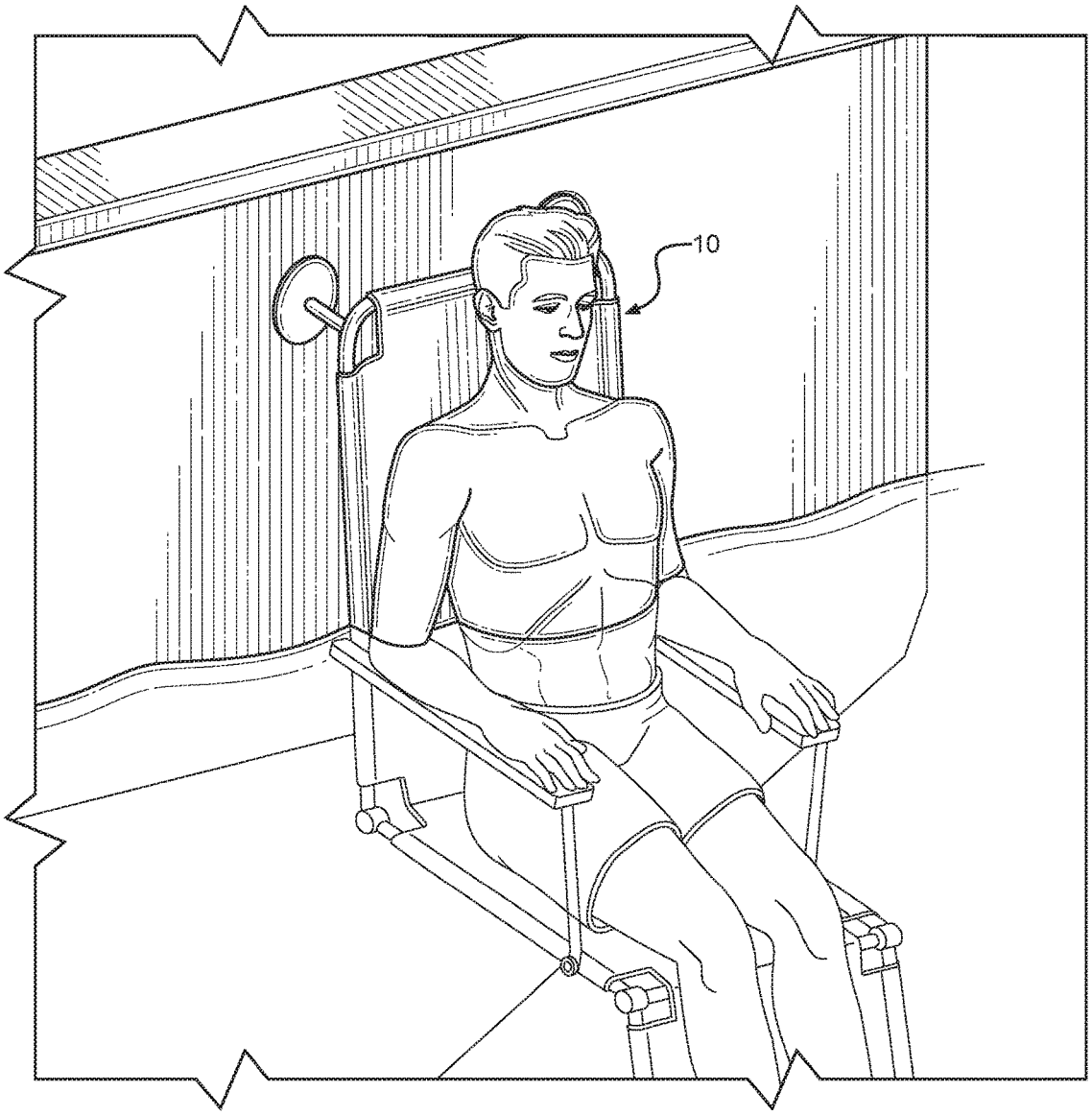
FIG. 5 shows a perspective view of the watercraft chair with a user seated thereon.

Referring now to FIG. 5, there is shown a perspective view of the watercraft chair with a user seated thereon. The watercraft chair 10 is configured to be usable when partially submerged in water. The user may adjust the height of the watercraft chair 10 relative to the surface of the water to be submerged at a desired level through the displacement and replacement of the plurality of fasteners.

Figure 6:
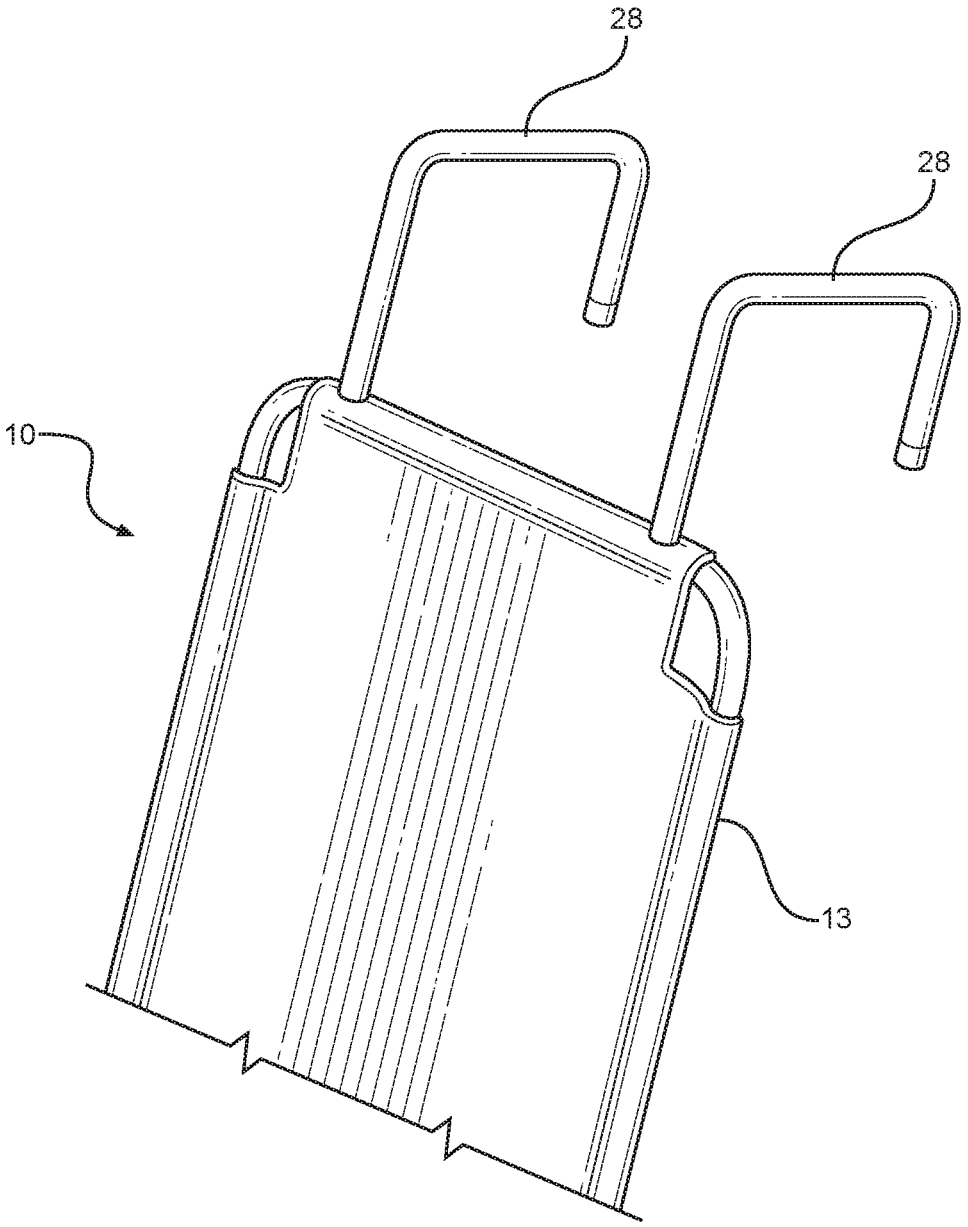
FIG. 6 shows a perspective view of an embodiment of the watercraft chair.

Referring now to FIG. 6, there is shown a perspective view of an embodiment of the watercraft chair. In one embodiment, the watercraft chair 10 further comprises a plurality of support hooks 28 disposed on a top section of the backrest frame 13. The plurality of support hooks 28 is configured to provide additional support to the watercraft chair 10.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art and all equivalent relationships to those illustrated in the drawings and described in the specification are intended to be encompassed by the present invention.

Therefore, the foregoing is considered as illustrative only of the principles of the invention. Further since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachable watercraft chair, comprising:

a frame assembly including a seat frame, a backrest frame and a footrest frame;

wherein the footrest frame is movably connected to the seat frame and the backrest frame is movably connected to the seat frame opposite of the footrest frame;

a covering over the frame assembly adapted to receive the body of a user;

a plurality of fasteners attached to the backrest frame configured to secure the watercraft chair to a side of a watercraft;

wherein the plurality of fasteners comprises at least one fastener configured to be placed underwater and at least one fastener configured to be placed above water;

the plurality of fasteners is attached to the backrest frame by a plurality of adjustable arms comprised of a first arm slidably receivable into a second arm with sufficient frictional resistance to maintain a stable position.

2. The attachable watercraft chair of claim 1, further comprising a plurality of arm rests configured to allow a user to rest the arms of the user thereon.

3. The attachable watercraft chair of claim 1, wherein the covering is made from a waterproof material.

4. The attachable watercraft chair of claim 1, wherein the frame assembly and covering are configured to have a folded position and a usable position wherein the user can switch between these positions without interfering with an action of the plurality of fasteners.

5. The attachable watercraft chair of claim 1, wherein the plurality of fasteners is a plurality of suction cups.

6. The attachable watercraft chair of claim 5, wherein the plurality of suction cups is a plurality of lever-actuated suction cups.

7. The attachable watercraft chair of claim 1, wherein the plurality of fasteners is connected to a plurality of hinges to allow the watercraft chair to be moved to a desired angle.

8. The attachable watercraft chair of claim 1, further comprises a plurality of support hooks disposed on a top surface of the backrest frame.

* * * * *